US006068041A

United States Patent [19]

Miles et al.

[11] Patent Number: 6,068,041

[45] Date of Patent: May 30, 2000

[54] ADJUSTABLE PARTITION ASSEMBLY

[75] Inventors: George Miles, West Olive, Mich.; Eric Chan, New York, N.Y.

[73] Assignee: Herman Miller Inc., Zeeland, Mich.

[21] Appl. No.: 09/320,958

[22] Filed: May 27, 1999

Related U.S. Application Data

[60] Provisional application No. 60/087,579, Jun. 1, 1998.

[51] Int. Cl.[7] ..... A47G 5/00

[52] U.S. Cl. ..... 160/135; 160/211

[58] Field of Search ..... 160/135, 351, 160/352, 233, 197, 202, 211, 216, 222; 52/239

[56] References Cited

U.S. PATENT DOCUMENTS

| | | | |
|---|---|---|---|
| 3,463,218 | 8/1969 | Cannon et al. | 160/135 |
| 3,565,152 | 2/1971 | Cohn et al. | 160/135 |
| 3,677,322 | 7/1972 | Brorson et al. | 160/135 |
| 3,750,737 | 8/1973 | Woodward | 160/206 |
| 5,417,272 | 5/1995 | Marlowe et al. | 160/202 |
| 5,832,980 | 11/1998 | Cianciolo | 160/211 X |
| 5,908,064 | 6/1999 | Bruce | 160/211 X |

*Primary Examiner*—David M. Purol
*Attorney, Agent, or Firm*—Brinks Hofer Gilson & Lione

[57] ABSTRACT

A portable adjustable partition is provided. The partition includes a first base barrier member and a second base barrier member wherein the first base barrier member is pivotably connected to the second base barrier member. First and second slidable barrier members are connected to the first base barrier member and the second base barrier member, respectively. A first glide member is connected to the first telescoping barrier member and a second glide member is connected to the second telescoping barrier member. A pivot limiter is attached to one of the first base barrier member and the second base barrier member.

19 Claims, 7 Drawing Sheets

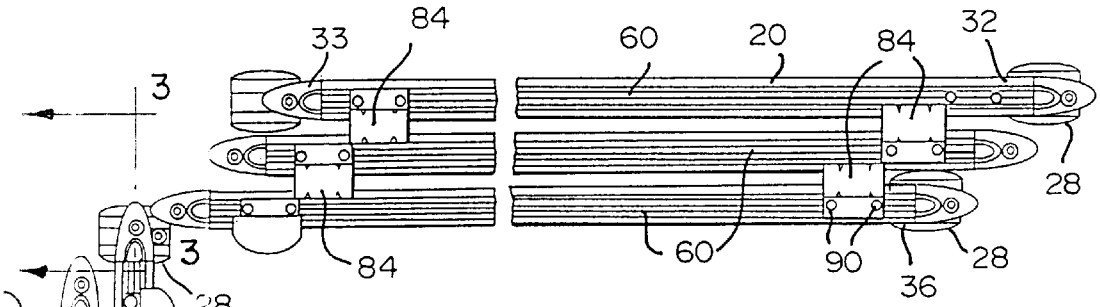
FIG. 2
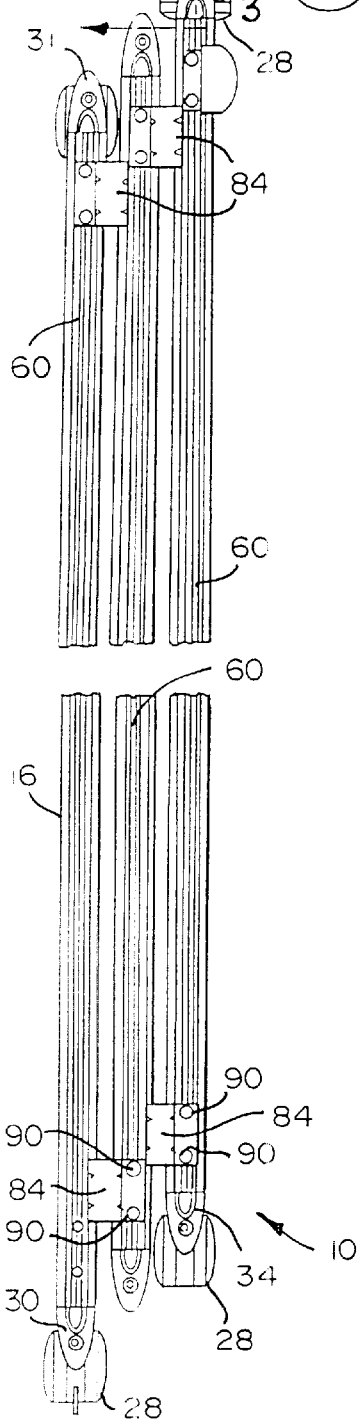
FIG. 3
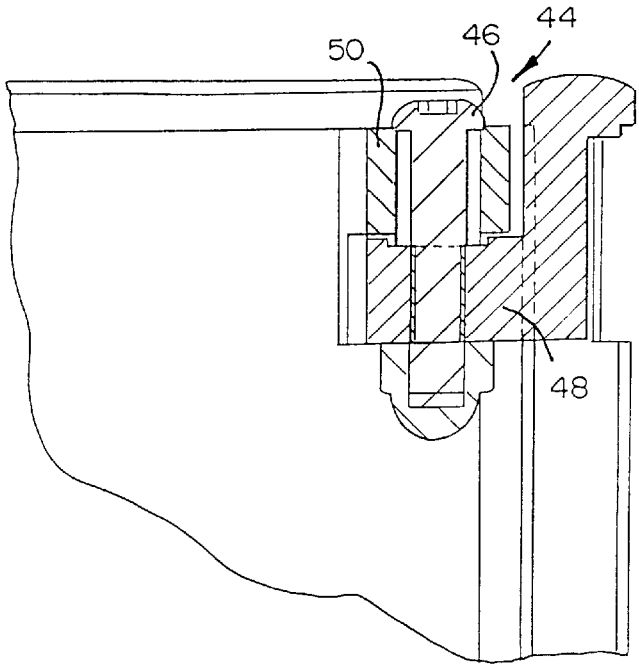

ADJUSTABLE PARTITION ASSEMBLY

RELATED APPLICATION

This application claims the benefit of the filing date pursuant to 35 U.S.C. §119(e) of Provisional Application Ser. No. 60/087,579, filed Jun. 1, 1998, the disclosure of which is hereby incorporated by reference.

BACKGROUND OF THE INVENTION

The present invention relates generally to the field of adjustable partitions. In particular, the present invention relates to a versatile adjustable screen capable of defining a wide variety of partially enclosed work spaces.

In an open work space environment, a user sometimes needs to define a partially enclosed space for various purposes, e.g., to have a meeting or for privacy. Obviously, depending on the number of people attending the meeting as well as the purpose of the meeting, a wide variety of work space configurations can be necessary. Various wall configurations have been developed to solve these problems. For example, one attempt to solve this problem includes placing portable walls adjacent to the desired work area. Another attempt to solve this problem includes having fixed walls with adjustable portions.

While these previous structures can address certain work space needs, they suffer from certain limitations. For example, it may not be easy to move a portable wall to the desired work area because of its weight. Also, they often provide little overall versatility, i.e., only limited angular and length adjustably, for a user trying to adjustably enclose a particular work area. More specifically, an adjustable wall that extends in only one direction may be unsatisfactory because the user may have varying needs that require a partition to extend in different directions and lengths. Once a meeting is finished, the user again faces the cumbersome task of having to return the portable wall to storage.

Many adjustable walls also lack functional versatility. They provide nothing more than a boundary that divides space. For example, people attending a meeting may need a marker board. However, a separate marker board would then have to be brought in and set up in the work area.

Therefore, there is a need for an improved adjustable wall assembly that is capable of being easily moved and adjusted to a wide variety of positions while having a functional versatility.

SUMMARY OF THE INVENTION

The present invention is directed to a portable partition that may be easily moved while having a versatile configurational and functional capability.

Briefly stated, a first aspect of the present invention is directed to a portable adjustable partition. The partition includes a first base barrier member and a second base barrier member wherein the first base barrier member is pivotably connected to the second base barrier member. First and second slidable barrier members are connected to the first base barrier member and the second base barrier member, respectively. A first glide member is connected to the first telescoping barrier member and a second glide member is connected to the second telescoping barrier member. A pivot limiter is attached to one of the first base barrier member and the second base barrier member.

According to another aspect of the invention, the portable adjustable partition includes a third slidable barrier and a fourth slidable barrier connected to the first base barrier member and the second base barrier member.

According to yet another aspect of the invention, the pivot limiter is attached to an inner surface of one of the first base barrier member and the second base barrier member.

According to a further aspect of the invention, the top surface of the first and second base barrier members and the first, second, third and fourth slidable barrier members includes a rail and slide member.

As used herein, the term "barrier member" is intended to include panels of a wide variety of appearances and functional capabilities, e.g., translucent panels, tackable panels or panels having a marker board capability.

The present invention, together with attendant objects and advantages, will be best understood with reference to the detailed description below in connection with the attached drawings.

BRIEF DESCRIPTION OF THE DRAWINGS

FIG. 2 is a top view partially broken away of the adjustable partition;

FIG. 3 is a cross-section taken along the lines 3—3 of FIG. 2 illustrating the hinge used to interconnect the two sets of screens;

DETAILED DESCRIPTION OF THE PREFERRED EMBODIMENTS

The invention is described with reference to the drawings in which like elements are referred to by like numerals.

Figure 1:
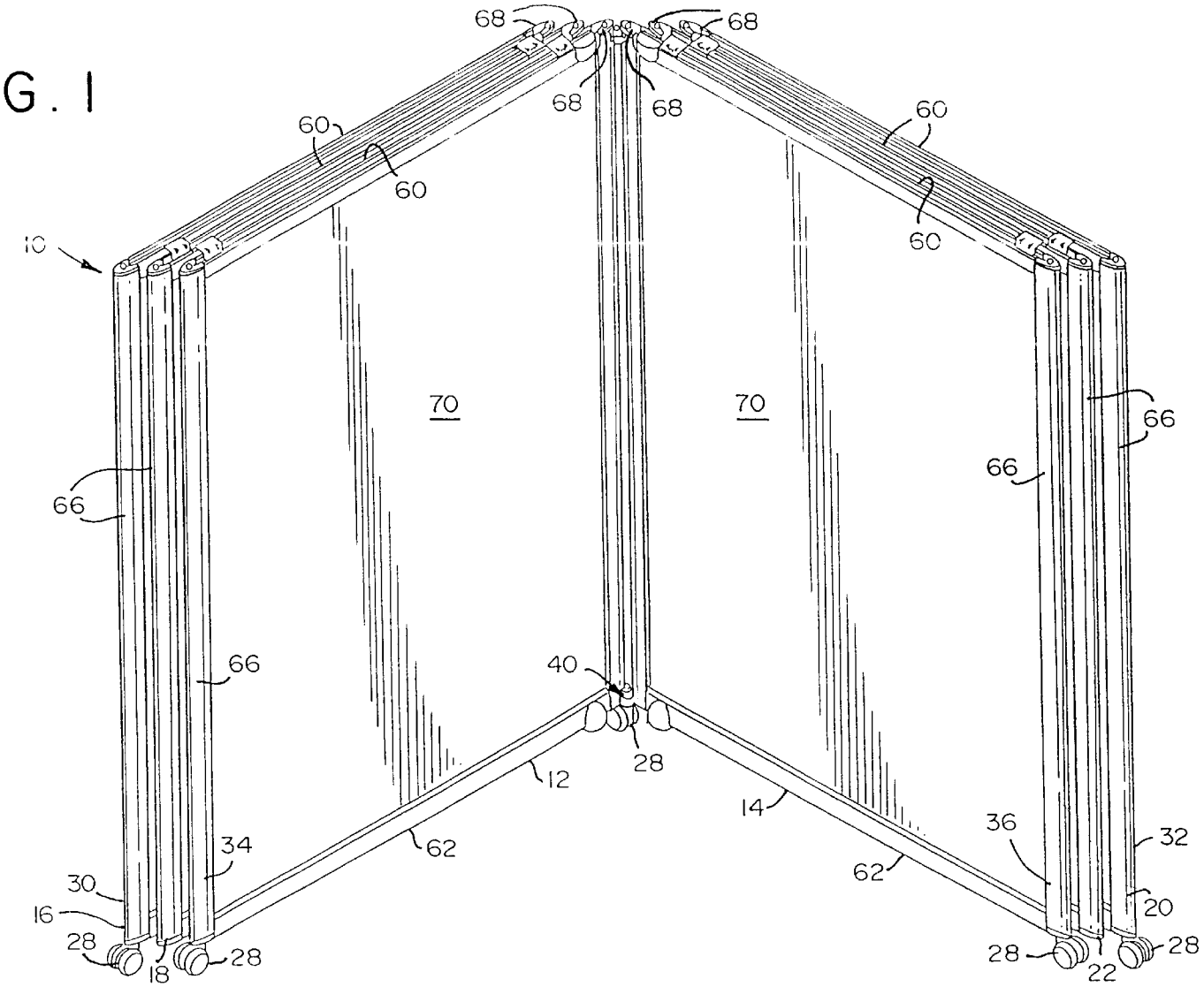
FIG. 1 is a perspective view of an adjustable partition constructed in accordance with a first preferred embodiment.

FIG. 1 illustrates a portable adjustable partition 10 in accordance with a preferred embodiment of the present invention. The adjustable partition 10 includes first and second base barrier members or screens 12 and 14. Two telescoping screens 16, 18 are connected to the first base barrier member 12. Likewise, two telescoping screens 20, 22 are connected to the second base barrier member 14. While the preferred embodiment illustrated in FIG. 1 includes a total of six screens, it should be recognized that as few as four screens could be used with the present invention or as many as eight or more screens could be used.

As best seen in FIG. 1, glide members or wheels 28 are attached at various locations to the adjustable partition 10. As shown in the preferred embodiment, wheels are attached at both ends 30, 31, 32, 33 of the telescoping screens 16, 20, and the ends 34, 36 of the first and second base screens 12, 14. In addition, a wheel 28 is attached to a pivot bracket 40 that interconnects the first base screen 12 and the second base screen 14. As those of ordinary skill in the art will recognize, other glide mechanisms and wheel arrangements may be used to provide the adjustable partition with a movement capability.

Figure 5:
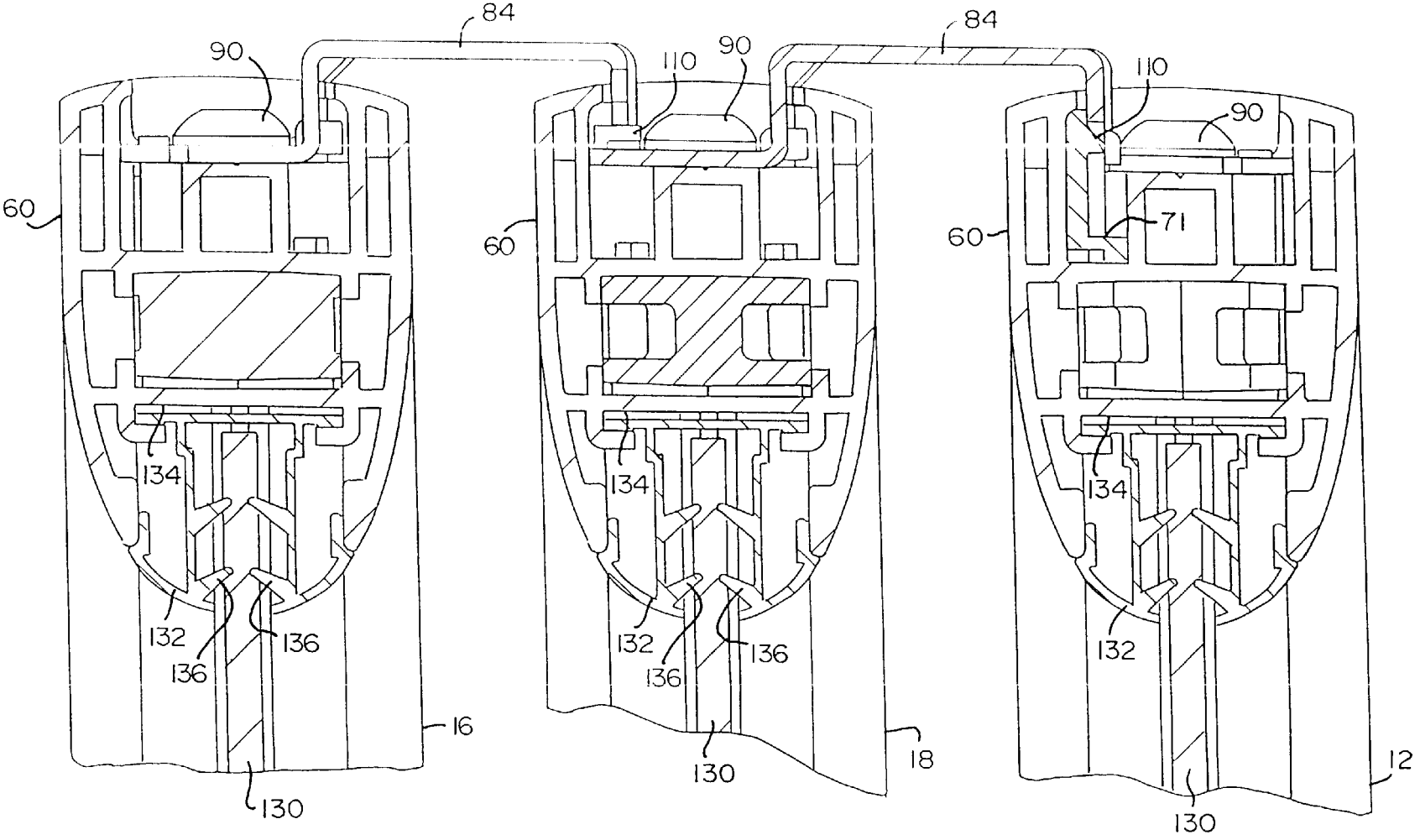
FIG. 5 is a cross-section of an alternate embodiment similar to FIG. 1 except that three translucent screens are shown.
Figure 14:
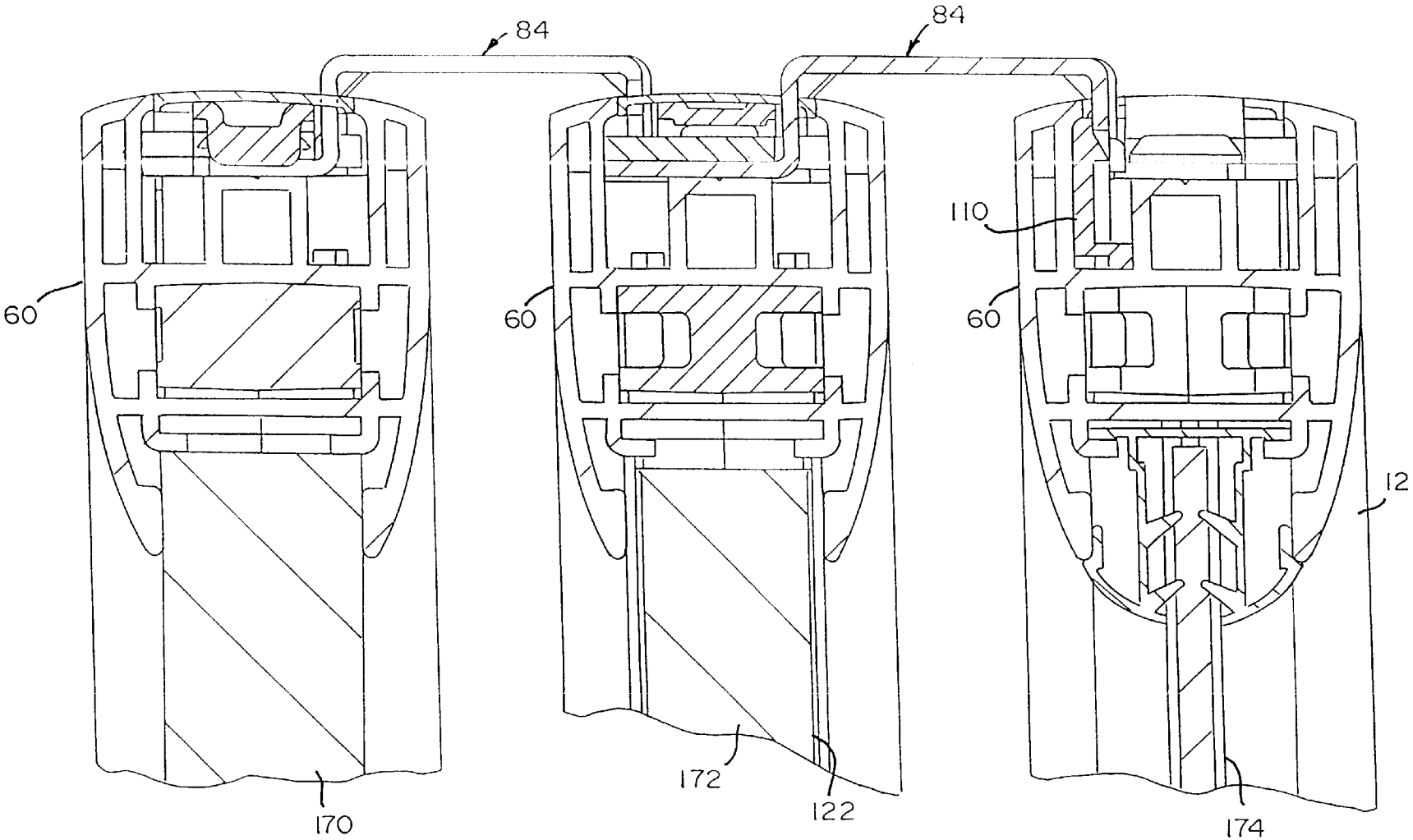
FIG. 14 is a top cross-section of an alternate embodiment similar to FIG. 5 except that a marker board, tackable panel and translucent screen are shown.

The top pivot bracket 44 is illustrated in FIG. 3. A pivot 46 connects the arms 48,50 that extend from the base screens 12,14. The base screens 12, 14 and the telescoping screens 16, 18, 20 and 22 include a top rail 60 and bottom rail 62. The top rail 60 and bottom rail 62 have the same basic structure. The base screens 12, 14 and the telescoping screens 16, 18, 20 and 22 include a front connection member 66 and rear connection member 68. Barrier members or panels 70 are secured between the top rails 60, the bottom rails 62, and the front connection members 66 and rear connection members 68. While panels 70 in FIG. 1 illustrate the use of a tackable material, the cross-section of FIGS. 5 and 14 shows alternate embodiments including the use of a marker board material and a translucent material. However, a wide variety of materials having varying functional characteristics can be used with the present invention.

Figure 6:
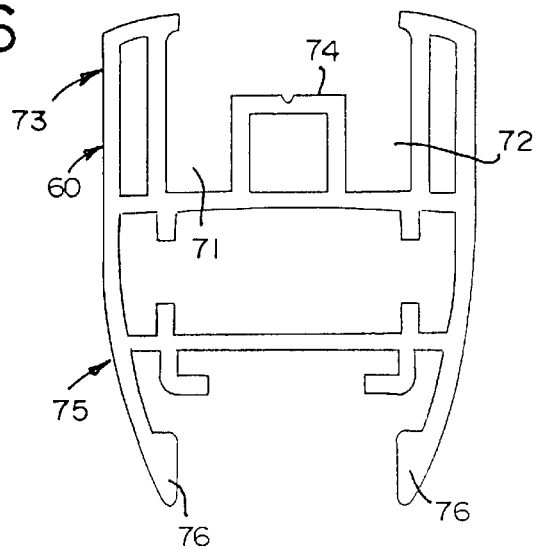
FIG. 6 is a cross-section taken along the lines 6—6 of FIG. 2 illustrating the rail.

The top rail 60 is best illustrated in FIG. 6. The top rail 60 includes two substantially parallel tracks 71, 72 located within an upper portion 73 of the rail 60. A divider 74 separates the parallel tracks 71, 72. The lower portion 75 includes two inwardly projecting clamping members 76 that secure, in part, the barrier or screen 70.

Figure 7:
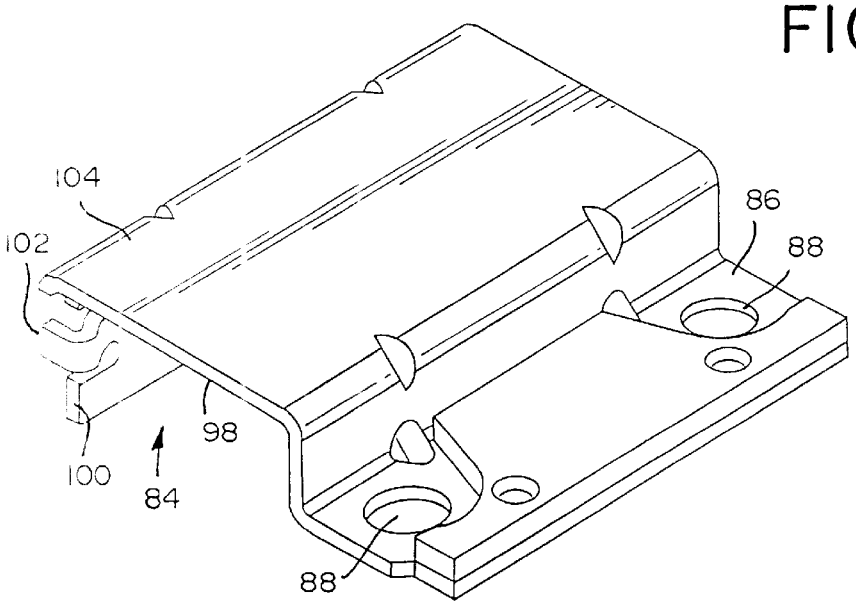
FIG. 7 is a front perspective view of the slide bracket.
Figure 8:
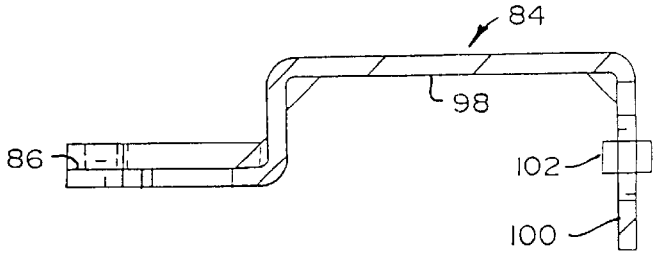
FIG. 8 is a side view of the slide bracket shown in FIG. 7.

FIG. 7 best illustrates the slide bracket 84 that interconnects the base screens 12, 14 to their respective telescoping screens 16, 18, 20 and 22. More specifically, slide brackets 84 interconnect the top rails 60 and the bottom rails 62. The slide bracket 78, as assembled, is best illustrated in the top view shown in FIGS. 2 and 4. Referring again to FIG. 7, the slide bracket 84 includes an attachment portion 86 having openings 88. Bolts 90 are used to secure the slide bracket 84 to top rail 60 or more specifically, the dividers 74. An interscreen extension portion 98 spans the gap between adjacent telescoping screens, i.e., between base screen 12 and telescoping screens 16 and 18 and base screen 14 and telescoping screens 20, 22. A slide support portion 100 extends downward from the interscreen extension portion 98. A curved outwardly projecting finger 102 extends from an end 104 of slide bracket 84. The stop or finger 102 mates with a notched surface on an adjacent bracket 84 in order to provide a connection between adjacent brackets in order to limit any movement between adjacent screens. Preferably, the slide bracket 84 is constructed from cold rolled steel.

Figure 9:
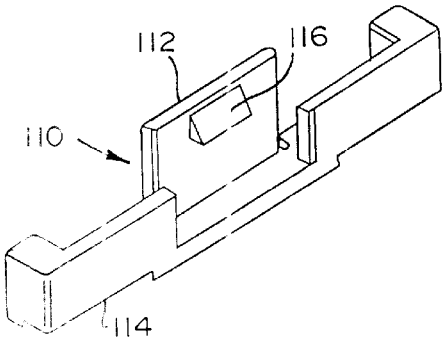
FIG. 9 is a front perspective view of the slide member.
Figure 10:
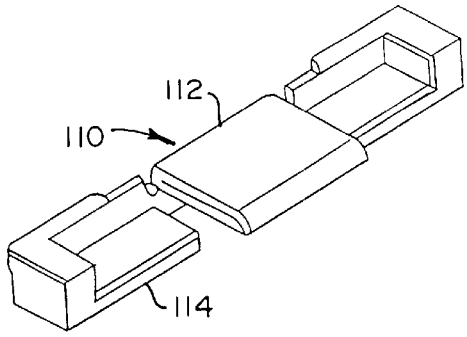
FIG. 10 is a side view of the slide member.

A slide member 110, as best seen in FIGS. 9–10, is attached to the slide support portion 100 of the slide bracket 84. The slide member 110 includes opposing outer surface 112 and 114 that are secured around the slide support portion 100 of the slide bracket 84. The outer wall 112 includes an upstanding finger 116 that extends into an aperture (not shown) in the slide bracket 84. The aperture is sized such that slide member 112 is slightly movable therein in a vertical and angular direction. Preferably, the slide member 110 is formed from a polyurethane material.

FIG. 5 illustrates the interconnection of an embodiment of the present invention. While FIG. 5 illustrates the interconnection of the top rails 60, the interconnection of the bottom rails 62 has the same base construction. As best seen in the interconnection of the base screen 12 and the telescoping screen 18, the slide member 110 rides in the track 71. This same configuration exists with respect to the interconnection, both top and bottom, of the remaining screens. As illustrated in FIG. 5, slide member 110 is positioned within the track 71. The slide member 110 may be moved between the positions illustrated in FIG. 4 by sliding along the track 64. In combination, the slide brackets 84, both top and bottom, cooperate to clamp the base screens 12, 14 and the telescoping screens 16, 18, 20, 22 therebetween. In this manner, the assembly remains connected. FIG. 5 also illustrates the use of a translucent screen 130 in place of a tackable material. When using a translucent screen 130, a clip 132 is attached to a bottom bracket 134 in the rails 60. The clip 132 includes a plurality of opposing flexible fingers 136 that secure the translucent screen 130 therebetween. The clip 132 is not necessary when a thicker material, e.g., a tackable material or a market board material, is used. The clip 132 is preferably formed from extruded rigid PVC.

Figure 11:
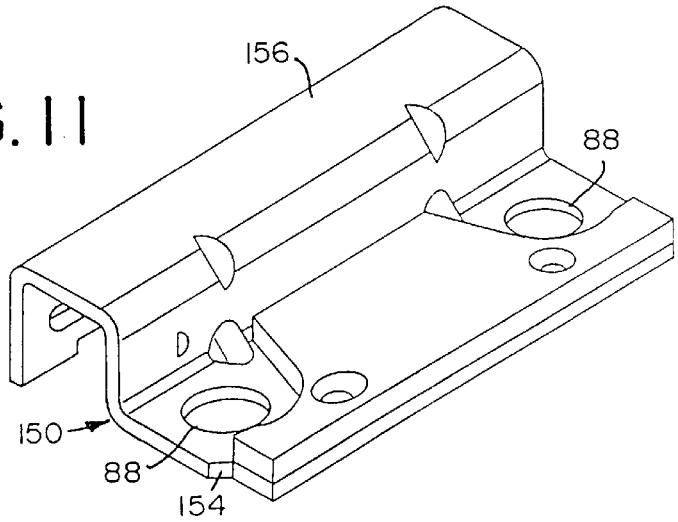
FIG. 11 is a front perspective view of a limiter bracket.
Figure 13:
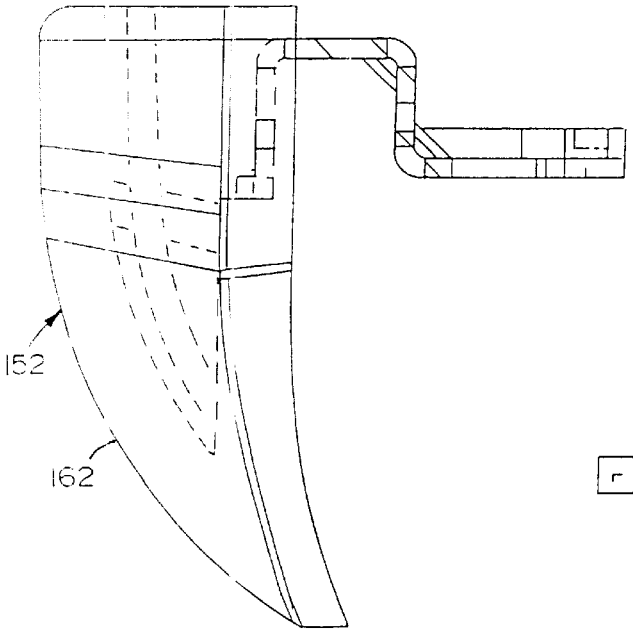
FIG. 13 is a side view showing the limiter attached to the limiter bracket.
Figure 12:
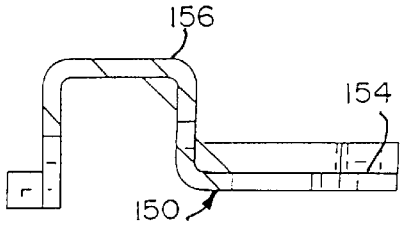
FIG. 12 is a side view of the limiter bracket shown in FIG. 11.

FIG. 11 best illustrates the pivot limiter bracket 150. The pivot limiter bracket 150 connects the pivot limiter 152, as seen in FIGS. 1, 2, 4 and 13, to upper and lower rails 60, 62 of the base screens 12, 14. The pivot limiter bracket 150 includes an attachment portion 154 having openings 88. Bolts 90 are used to secure the pivot limiter bracket 150 to the top rail 60 or more specifically, the dividers 70. An extension portion 156 extends inward from the top rail 60. A mounting portion 158 extends downward from the extension portion 156.

Figure 4:
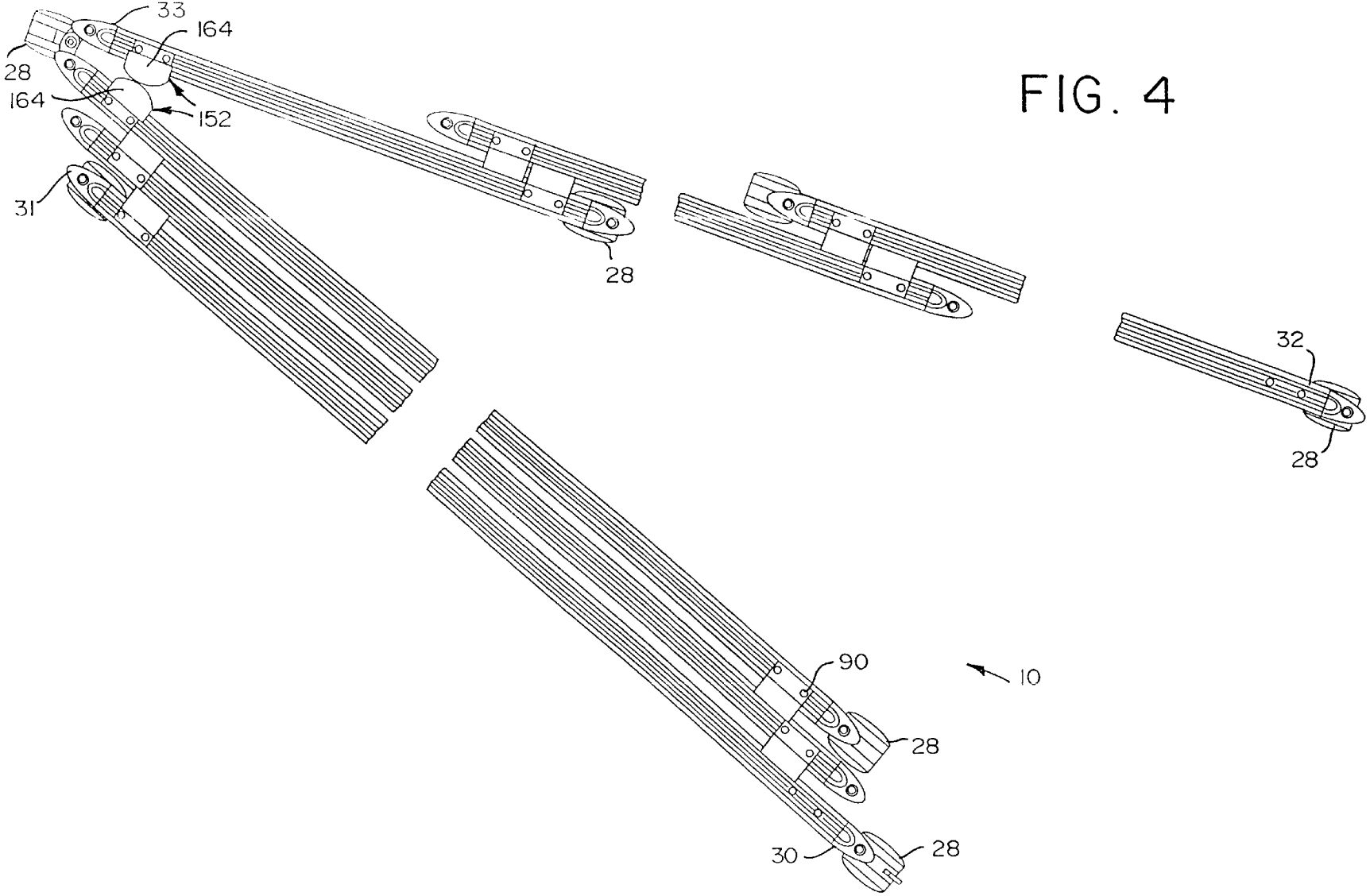
FIG. 4 is a top partially broken away view of the adjustable partition illustrating the use of the limiter.

The pivot limiter 152 is attached to the mounting portion 158 through a molding process in order to create a one-piece construction. The pivot limiter 152 includes a curved outer surface 162 that extends inward from the base screens 12, 14. As best seen in FIG. 4, pivot limiters 152 contact each other as the base screens 12, 14 are pivoted toward each other. The pivot limiter 152 prevents the screens from being positioned substantially parallel to each other. In the preferred embodiment, the pivot limiters 152 are sized such that the base screens cannot be positioned with less than a 20 degree angle therebetween. This feature is important because it prevents the adjustable partition 10 from assuming an unstable position. It is intended that the adjustable partition 10 be positioned as shown in FIG. 4 when it is moved from location to location. Preferably, the pivot limiter 152 is formed from a thermoplastic elastomer.

The embodiment of FIGS. 14 and 15 function in essentially the same manner as do the embodiments of FIGS. 1 and 5, except that a marker board 170, a tackable material 172 and a translucent screen 174 are illustrated.

The embodiments described above and shown herein are illustrative and not restrictive. The scope of the invention is indicated by the claims rather than by the foregoing description and attached drawings. The invention may be embodied in other specific forms without departing from the spirit of the invention. For example, the number or type of screens may be varied without departing from the claimed invention. Accordingly, these and any other changes which come within the scope of the claims are intended to be embraced herein.

We claim:

1. A portable adjustable partition comprising:

(a) a first base barrier member and a second base barrier member wherein the first base barrier member is pivotably connected to the second base barrier member;

(b) a first slidable barrier member and a second slidable barrier member connected to the first base barrier member and the second base barrier member, respectively;

(c) a first glide member connected to the first telescoping barrier member and a second glide member connected to the second telescoping barrier member;

(d) a pivot limiter attached to one of the first base barrier member and the second base barrier member.

2. The portable adjustable partition of claim 1 further comprising a third slidable barrier and a fourth slidable barrier connected to the first base barrier member and the second base barrier member.

3. The portable adjustable partition of claim 2 wherein the third slidable barrier interconnects the first base barrier member and the first slidable barrier member.

4. The portable adjustable partition of claim 3 wherein the third slidable barrier member interconnects the first base barrier member and the first slidable barrier member.

5. The portable adjustable partition of claim 4 wherein the pivot limiter is attached to an inner surface of one of the first base barrier member and the second base barrier member.

6. The portable adjustable partition of claim 5 wherein the pivot limiter comprises a first inwardly extending curved member and a second inwardly extending curved member, the first curved member being attached to the first base barrier member and the second curved member being attached to the second base barrier member.

7. The portable adjustable partition of claim 6 wherein the top surface of the first and second base barrier members and the first, second, third and fourth slidable barrier members includes a rail and slide member.

8. The portable adjustable partition of claim 7 wherein the slide members are attached to brackets connected to an adjacent panel.

9. The portable adjustable partition of claim 8 wherein the bracket includes an opening and the slide member is attached to the bracket by a finger that projects through the opening.

10. The portable adjustable partition of claim 9 wherein the slide members can move vertically with respect to the brackets.

11. The portable adjustable partition of claim 10 wherein the bottom surface of the first and second base barrier members and the first, second, third and fourth slidable barrier members includes a rail and slide member.

12. The portable adjustable partition of claim 10 wherein the slide members are attached to bottom brackets connected to an adjacent panel.

13. A telescoping privacy screen comprising:

(a) a first base barrier member and a second base barrier member wherein said first base barrier member is pivotably connected to said second base barrier member by upper and lower pivot brackets extending from upper and lower portions of the first base barrier member and the second base barrier member;

(b) a first slidable barrier member and a second slidable barrier member connected to the first base barrier member and the second base barrier member, respectively;

(c) a first glide member connected to the first telescoping barrier member, a second glide member connected to the second telescoping barrier member and a third glide member connected to lower pivot bracket;

(d) a pivot limiter attached to one of the first base barrier member and the second base barrier member whereby the first base barrier member is prevented from being positioned substantially parallel with the second base barrier member.

14. The telescoping screen of claim 13 the glide member comprises wheels.

15. The telescoping screen of claim 14 the glide members comprise wheels.

16. The telescoping screen of claim 15 the glide members comprise wheels.

17. The portable adjustable partition of claim 15 wherein the pivot limiter is attached to an inner surface of one of the first base barrier member and the second base barrier member.

18. The portable adjustable partition of claim 16 wherein the pivot limiter comprises two inwardly extending surfaces extending from upper and inner portions of the first and second base barrier members.

19. The portable adjustable partition of claim 17 wherein the first and second base barrier members are prevented by the pivot limiter from creating less than a 20 degree angle therebetween.

* * * * *